US005343856A

United States Patent [19]

Proctor

[11] Patent Number: 5,343,856

[45] Date of Patent: Sep. 6, 1994

[54] COMPLETE BODY PASSIVE EXERCISE MACHINE

[76] Inventor: Alfred E. Proctor, P.O. Box 183, Beechmont, Ky. 42322

[21] Appl. No.: 977,666

[22] Filed: Nov. 18, 1992

[51] Int. Cl.[5] ..... A61H 1/02

[52] U.S. Cl. ..... 601/35; 482/60; 482/62; 482/79; 601/33

[58] Field of Search ..... 128/25 R, 26, 25 B; 482/57, 60, 62, 79, 80, 147

[56] References Cited

U.S. PATENT DOCUMENTS

| | | | |
|---|---|---|---|
| 2,261,355 | 11/1941 | Flynn | 128/25 R |
| 2,707,465 | 5/1955 | Nemeth | 128/25 R |
| 3,112,108 | 11/1963 | Hanke | 482/57 |
| 3,625,203 | 12/1971 | Wadelton | 128/25 |
| 3,762,703 | 10/1973 | Gibbs | 482/57 |
| 3,895,623 | 7/1975 | Mahlandt | 128/25 |
| 4,396,188 | 8/1983 | Dreissigacker . | |
| 4,402,502 | 9/1983 | Peters | 128/25 R |
| 4,478,213 | 10/1984 | Redding | 128/25 |
| 4,560,165 | 12/1985 | Witteman et al. | 482/147 |
| 4,572,501 | 2/1986 | Durham et al. | 272/73 |
| 4,605,220 | 8/1986 | Troxel | 482/79 |
| 4,647,035 | 3/1987 | Yellen . | |
| 4,671,257 | 6/1987 | Kaiser et al. | 128/25 |
| 4,773,399 | 9/1988 | Richardson | 128/25 |
| 4,798,378 | 1/1989 | Jones . | |
| 4,807,874 | 2/1989 | Little | 482/80 |
| 4,822,038 | 4/1989 | Maag | 482/80 |
| 4,869,494 | 9/1989 | Lambert, Sr. | 128/25 R |
| 4,928,673 | 5/1990 | Heneger | 128/25 R |
| 4,953,541 | 9/1990 | Parker, Jr. | 128/25 |
| 5,005,825 | 4/1991 | Fogel | 482/60 |
| 5,033,736 | 7/1991 | Hirschfeld | 128/25 R |
| 5,062,629 | 11/1991 | Vaughan | 482/147 |
| 5,099,828 | 3/1992 | Duke | 128/25 |
| 5,127,892 | 7/1992 | Sawdon | 482/79 |

FOREIGN PATENT DOCUMENTS

| | | | |
|---|---|---|---|
| 0376403 | 7/1990 | European Pat. Off. . | |
| 0851234 | 10/1960 | United Kingdom | 128/25 R |

*Primary Examiner*—Richard J. Apley
*Assistant Examiner*—Jeanne M. Mollo

[57] ABSTRACT

The present device discloses a complete body passive exercise machine. A motor drives a crank shaft which rotates two foot plates about a given point. These foot plates are attached to limited slide joint assemblies which cause the foot plates to flex forwardly and rearwardly while they are being moved in a circle thereby exercising the legs and ankles. The crankshaft is also operatively attached to arm levers which are held onto by the user. The arm levers work such that the one of the user's arms is fully extended while the other is close to the user's body thereby working the arms as well as pivoting the torso.

9 Claims, 4 Drawing Sheets

COMPLETE BODY PASSIVE EXERCISE MACHINE

BACKGROUND OF THE INVENTION

The present invention relates generally to complete body passive exercise devices and more particularly to a machine which moves the arms forwardly and rearwardly, moves the legs up and down, rotates the ankles, and moves the feet.

It will be appreciated by those skilled in the art that individuals who are paraplegic, quadriplegic, or in rehabilitation, have the need for passive exercise machines which work muscles that the user can not work on his or her own. It will further be appreciated by those skilled in the art that all of the muscle groups must be worked and must be worked in specific ways in order to be effective. To this end, there have been several attempts to provide passive motion exercise devices.

U.S. Pat. No. 4,478,213 issued to D. Redding on Oct. 23, 1984, discloses a therapeutic limb manipulator. The Redding device only moves the legs. It fails to move the arms and torso.

U.S. Pat. No. 4,572,501 issued to C. Durham, et al. on Feb. 25, 1986, discloses a non-passive exercise device. The arms crank pedals which, in turn, move the feet. The range of motion of the feet is limited to rotation about a center point.

U.S. Pat. No. 4,773,399 issued to K. Richardson on Sep. 27, 1988, discloses an exercise device whereby the arms are passively moved forwardly and rearwardly and the feet are moved about a center point. Unfortunately, the movement of the legs is too limited.

U.S. Pat. No. 4,928,673 issued to F. Heneger on May 29, 1990, discloses a passive device which exercises the legs and moves the feet about a fixed position.

U.S. Pat. No. 5,033,736 issued to Hirschreid on Jul. 23, 1991, is a passive exercise bicycle which moves about a fixed point.

U.S. Pat. No. 4,671,257 issued to R. Kaiser on Jun. 9, 1987, discloses a device which moves the arms and legs. However, it is intended for a user in a reclined position. It is not accessible by wheel chair. The same is true for U.S. Pat. No. 5,099, 828 issued to C. Duke on Mar. 31, 1992 and for U.S. Pat. No. 3,895,623 issued to L. Mahlandt on Jun. 22, 1975.

U.S. Pat. No. 4,953,541 issued to A. Parker, Jr. on Sep. 4, 1990, discloses a passive device which moves the user's arms and legs. Unfortunately, the leg movement is limited to an upward and downward motion.

U.S. Pat. No. 3,625,203 issued to D. Wadelton on Dec. 7, 1971, discloses a passive foot and leg exercise device. No work is done on the hands.

Similarly, U.S. Pat. No. 5,127,892 issued to F. Sawdon on Jun. 7, 1992, discloses an arch exerciser. Neither the hands nor the legs are moved.

What is needed, then, is a complete passive exercise machine. This needed machine must move and work the hands and arms. This needed device must also work the torso. This needed device must work the ankles as well as the legs. This device must work all of the major muscle groups at the same time. This device must be wheel chair accessible. This device is presently lacking in the prior art.

SUMMARY OF THE INVENTION

The present device discloses a complete body passive exercise machine. This machine has a motor which turns a series of cams which rotate two foot plates about a given point. These foot plates are attached to limited slide joint assemblies which cause the foot plates to pivot forwardly and rearwardly while they are being moved in a circle thereby exercising the legs and ankles. The cams are also operatively attached to arm levers which are held by the user. The arm levers work such that while one of the user's arms is fully extended the other is close to the user's body thereby working the arms as well as pivoting the torso.

Accordingly, one object of the present invention is to provide a complete body passive exercise machine.

Still another object of the present invention is to provide a machine which is wheel chair accessible.

Still another object of the present invention is to provide a machine that works the ankles and legs at the same time.

Still another object of the present invention is to provide a device to stabilize the legs of a paraplegic or quadriplegic in an upright position while exercising.

Still another object of the present invention is to provide a device which works the arms and torso at the same time.

DESCRIPTION OF THE PREFERRED EMBODIMENT

Figure 1:
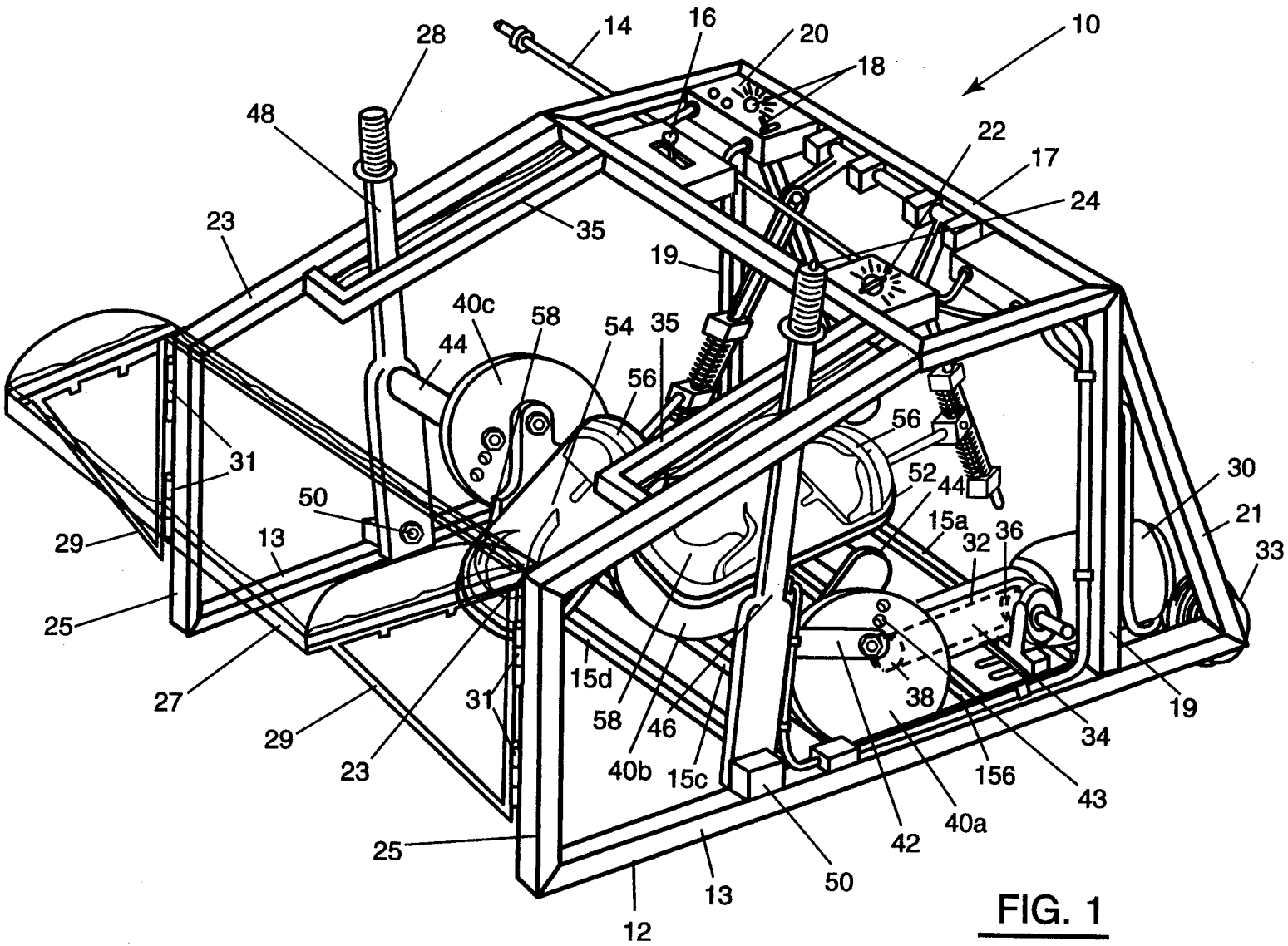
FIG. 1 is a perspective view of the complete body passive exercise machine of the present invention.

Referring now to FIG. 1 there is shown generally at 10 the complete body passive exercise machine of the present invention. Machine 10 has frame or housing 12 which is, in the preferred embodiment, made of one inch square tubing. Frame 12 is wheelchair accessible meaning that a user in a wheelchair can access and operate the machine. Accordingly, frame 2 is constructed of substantially parallel base members 13 joined by four transverse base members 15*a, b, c* and *d*. A substantially rectangular upper subframe 17 is supported along its rear margin by rear support members 19 and 21 and along its front margin by sloping outer lever guides 23. Outer lever guides 23 are joined to parallel base members 13 by front support members 25. Ultra-high molecular weight plastic (UHMW) non-friction wear strips are attached to lever guides 23. An optional padded seat assembly 27 can be pivotally attached to the top of front supports 25 and supported by swing frames 29 attached by removable hinges 31 to the front of supports 25. Seat 27 can also be adjusted back and forth, up and down for adjustment with longer or shorter legs. As seen on FIG. 5, when wheel chair access is desired, seat 27 is removed, exposing the front of machine 10. Wheels 33 are attached to the rear of frame 12 at floor level to allow for ease of movement of machine 10 by lifting from the front.

Machine 10 obtains conventional household AC electrical power through electrical cord 14 to removable key operated on-off safety switch 16. Electricity is then run to a conventional DC rectifier circuit and variable speed switch box 20 having on-off toggle switch 18. Direct current electricity comes out of box 20 at zero to ninety volts depending upon the speed setting desired. Current then runs to manual timer 22. In the preferred embodiment, manual timer 22 can be set to operate the machine from between zero to fifteen minutes. Electricity goes from manual timer 22 in series to momentary contact switch 24 which is, in the preferred embodiment, positioned on top of either right hand grip 26 or left hand grip 28. This allows the device to move only when the user is depressing switch 24.

Electrical power then goes to a one-fifth horsepower direct current motor 30 having, in the preferred embodiment, a fifty-to-one gear reducer. Motor 30 rotates first pulley 36 which turns belt 32 which is protected by guard 34. Belt 32 then rotates second belt pulley 38. In the preferred embodiment, pulleys 315, 38 are two and one-half inch diameter V-groove pulleys. Second V-pulley 38 turns a crank shaft (60 on FIG. 3) which joins three fly wheels 40*a, b,* and *c*.

The two outer fly wheels 40*a* and *c* are pivotally attached to arms 42 and 44 which, in turn, are pivotally attached to vertical levers 46 and 48. As the outer fly wheels (40*a,c*) rotate, right arm 42 and left arm 44 move levers 46, 48 in opposing forward and rearward linear motions between outer lever guides 23 and inner lever guides 35, pivoting about pins 50 attached to base members 13 of frame 12. Levers 46, 48 are timed from left to right such that left lever 48 is at its most forward position when right lever 46 is at its most rearward position. Multiple holes 43 are placed radially in outer flywheels 40*a* and 40*c* to allow for variable positioning of arms 42 and 44. Consequently, this allows for adjustment of the length of travel of levers 46 and 48.

Figure 3:
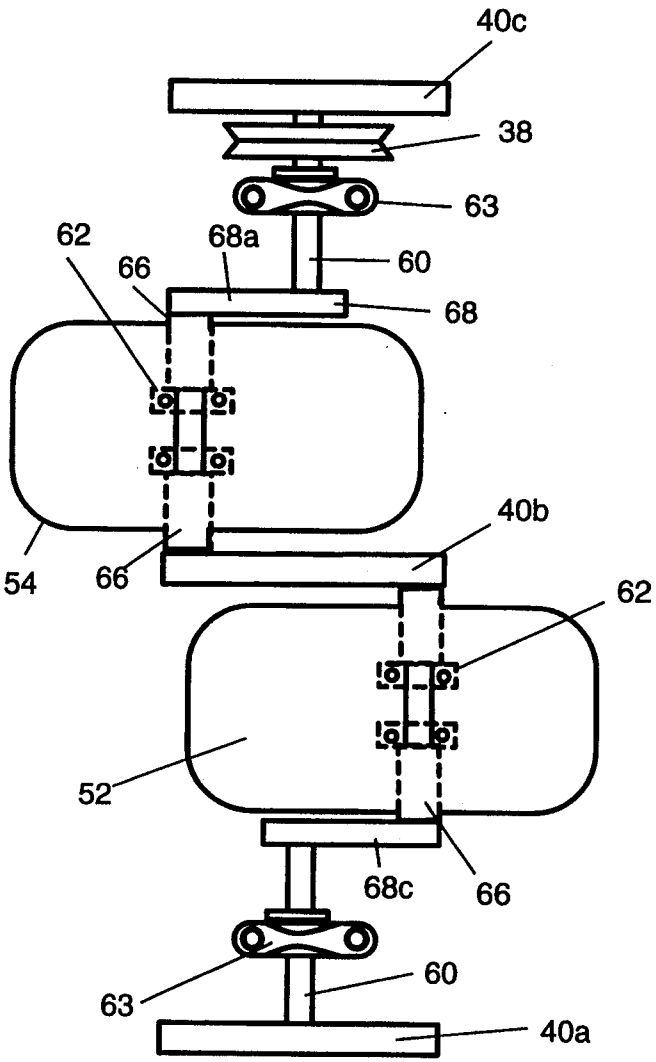
FIG. 3 is an underside view of the foot and ankle rotation assembly of the present invention.
Figure 2:
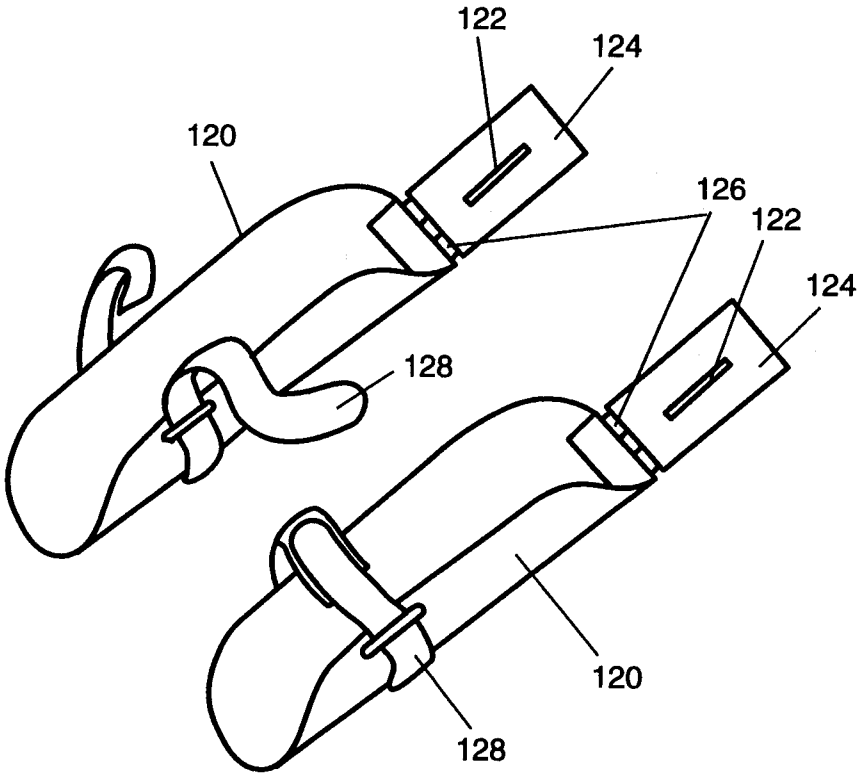
FIG. 2 is a perspective view of the optional hinged leg supports of the present invention necessary for paraplegics and quadriplegics.
Figure 4:
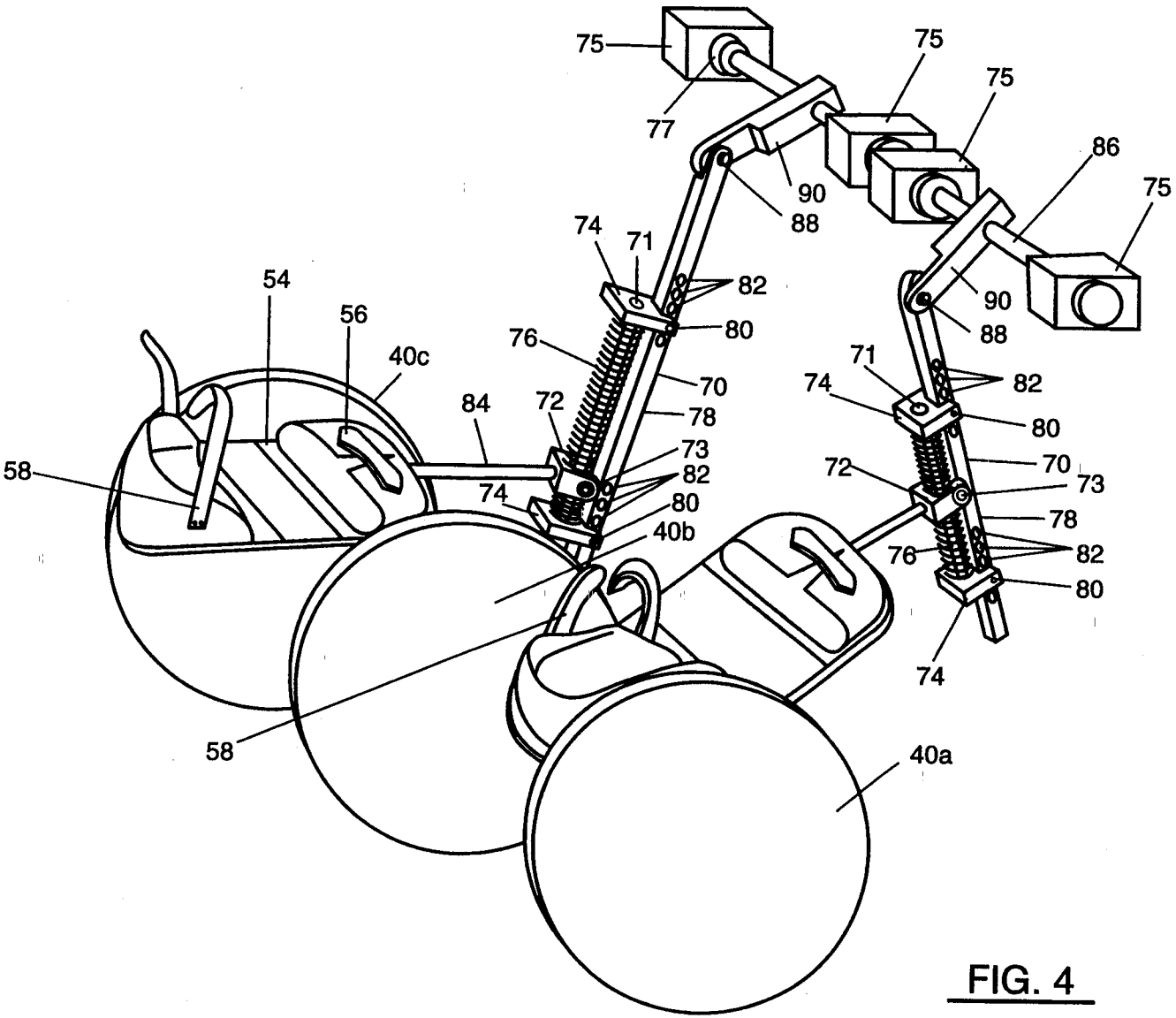
FIG. 4 is a perspective view of the limited slide joint assembly of the present invention.

Referring now to FIGS. 3–4, there is shown generally the feet and ankle rotation assemblies of the present invention. Right foot plate 52 and left foot plate 54, and fly wheels 40*a*, 40*b*, and 40*c* lie in the alignment shown in FIG. 4, coupled to crankshaft 60. Plates 52, 54 have toe straps 56 having ends connectable by hook and loop fabric and heel straps 58 having ends connectable by mating engagement fabric to engage and secure the user's feet. The underside of plates 52, 54 are attached to shaft 60 by bearings 62 which are pivotally coupled to crank arms 68 by collar bushings 156. Outer crank arms 68*a* and 68*c* attach to shaft 60 such that rotation of shaft 60 rotates outer crank arms 68*a* and 68*c*. Pulley 38 rotates shaft 60. Crank shaft 60 is coupled to outer flywheels 40*a* and 40*c* by self adjusting bearings 63. Right foot plate 52 is phased one hundred eighty degrees from left plate 54 such that left foot plate 54 is at its most forward position when fight plate 52 is at its most rearward position. Left arm lever (44 in FIG. 1) and left foot plate 54 are each phased so that both left arm lever (44 in FIG. 1) and left foot plate 54 are at their most forward position at the same time when both right lever (42 in FIG. 1) and fight foot plate 52 are together at their most forward position.

As seen on FIG. 4, the fronts of foot plates 52, 54 are attached by yoke shafts 84 to a limited slide joint 70. Each limited slide joint 70 includes a yoke 72 which slidably surrounds a guide shaft 71, suspended between two brackets 74 and compression springs 76. A UHMW plastic pivot and slide pin 73 passes through yoke 72, between slide shaft 71 and adjusting rod 78, and attaches with spring clips (not shown). Brackets 74 attach to adjusting rods 78 by pins 80 being received by adjustment holes 82. By varying the position of brackets 74 along rods 78, the angular orientation of plates 52, 54 can be varied. Springs 76 guide and slide to produce a gentle flexing of the ankles. Holes 82, in the preferred embodiment, allow yoke assembly 72 to be moved up or down substantially five inches. Bearing block 75 are attached to upper frame assembly 17 as seen on FIG. 4. Shaft bearings 77 join upper pivot shaft 86 to bearing blocks 75.

Upper pivot shaft assembly 86 attaches to joint assembly 70 by arms 90 which are rotatably secured to rods 78 by bolts 88, to give both a lift and a drop in arm 90 as they are pulled back and forth with rotation, thereby creating back and forth movement of foot plates 52 and 54. Additional adjustment range can be provided by varying the position of pivoting attachment of arms 90 to rods 78 by adjustment of arm 90 at bolt 88.

With movement of foot plates 52, 54 rotating in a pedal-like motion connected to joint assembly 70, and the rise and drop of two arms 90, the ankles are given a soft flexing motion both downwardly and upwardly as the pedal motion flexes both the legs and hip joints. By grasping arm levers 46, 48, the user works the upper torso.

Figure 5:
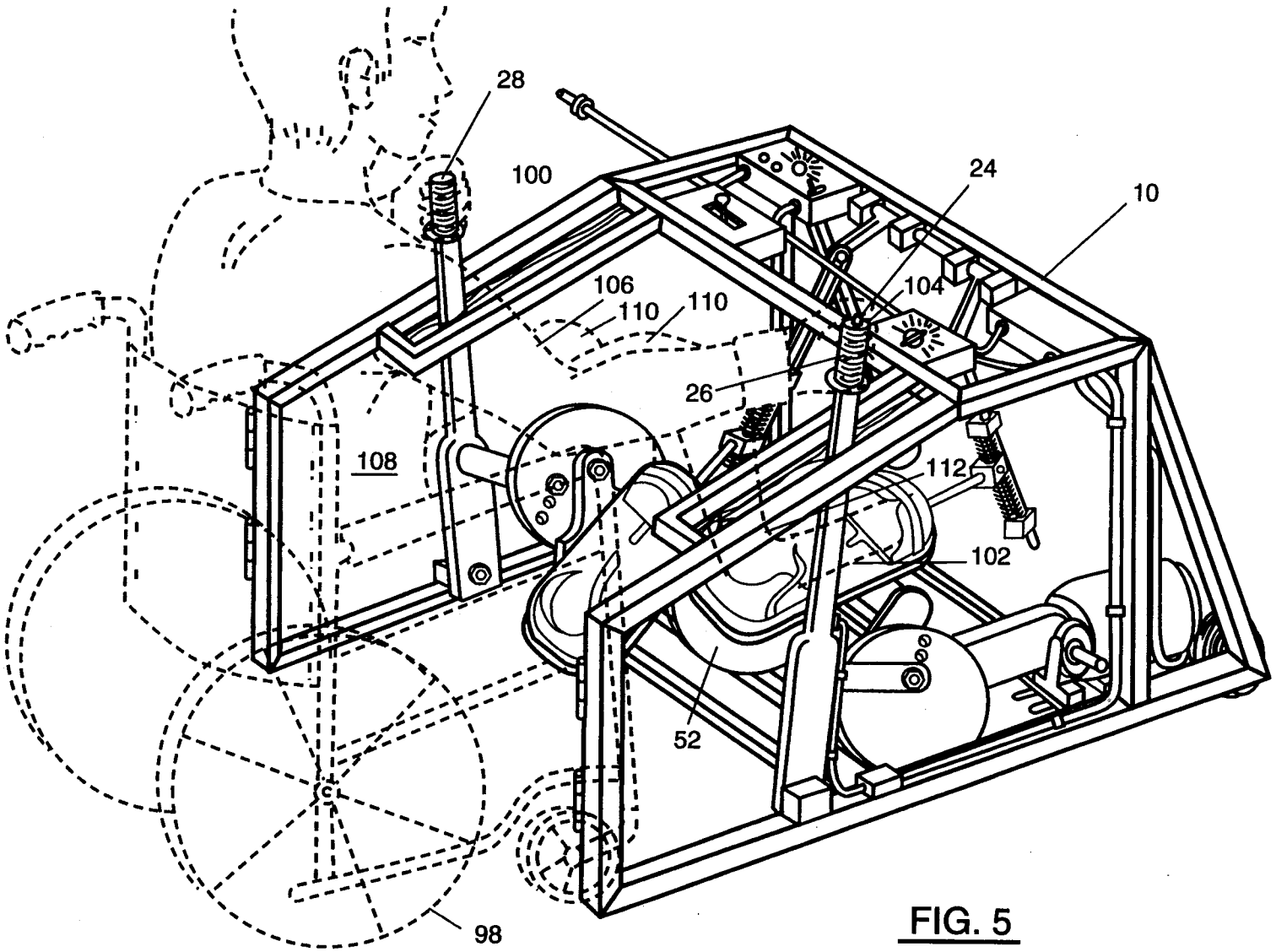
FIG. 5 is a perspective view of the machine as it is being used from a wheel chair.

Referring now to FIG. 5 there is shown generally at 10 the machine of the present invention with seat 27 removed, allowing wheel chair access. As can be seen, user 100 rolls wheel chair 98 into machine 10 securing feet 102 in plates 52, 54. User 100 turns safety a.c. switch 16 on, selects the desired speed on switch box 20, turns d.c. switch 18 on, activates timer. User 100 then places hands 104 onto grips 26, 28 activating momentary switch 24 and starting motor 30. Arms 106 are moved forwardly and rearwardly and torso 108 is slightly twisted back and forth. Similarly, legs 110 are moved upwardly and downwardly whereas ankles 112 are flexed and rotated by plates 52, 54.

If the user is paraplegic, it is necessary to use hinged leg supports 120 which are attached in a conventional manner below heel supports 58 on foot plates 52 and 54. By attaching leg supports 120 to plates 52 and 54 through adjustment slots 122 in hinge plate 124, which rotates around hinge 126, the users legs can be worked back and forth while being held upright within leg straps 128.

Thus, although there have been described particular embodiments of the present invention of a new and useful complete body passive exercise machine, it is not intended that such references be construed as limitations upon the scope of this invention except as set forth in the following claims. Further, although there have been described certain dimensions used in the preferred embodiment, it is not intended that such dimensions be construed as limitations upon the scope of this invention except as set forth in the following claims.

What I claim is:

1. A device for providing simultaneous passive exercise of the feet and ankles, arms, legs, and torso of a user, comprising:

a. a frame;

b. means attached to said frame for moving the feet and the legs of the user in a substantially circular pattern along a vertical plane comprising a first foot plate and a second foot plate for receiving one of said feet, plates having an upper side and a lower side, said underside of each of said foot plates slidably and pivotally attached to a cam arm;

c. means attached to said frame for flexing of the feet and the ankles of the user through an adjustable vertical range of motion comprising limited slide joints pivotally attached to said frame, each of said limited slide joints having an adjustment rod attached to a guide shaft by two brackets which are releasibly and adjustibly attached along adjustment rod, each of said limited slide joint having a spring receiving said guide shaft, each of said limited slide joint attached to one of said foot plates; and d. means attached to said frame for moving the arms of the user forwardly and rearwardly.

2. The device of claim 1 wherein said means for moving the feet and legs of the user in a substantially circular pattern along a vertical plane and said means for moving the arms of the user forwardly and rearwardly are operatively connected such that the right foot and the right arm of the user are in forward positions when the left arm and the left foot of the user are in rearward positions closest to the user.

3. The device of claim 1 wherein said means for moving the feet and the legs of the user in a substantially circular pattern along a vertical plane comprises said cam arm pivotally connected to a rotating crankshaft.

4. The device of claim 3 wherein said means for flexing of the feet and the ankles of the user comprises limited slide joints are attached to an upper shaft assembly.

5. The device of claim 4 wherein said limited slide joint assembly further comprises:

a. a yoke attached to each of said foot pads and slidably engaging said guide shaft; and said springs surrounding said guide shaft and flexibly suspending said yoke along said guide shaft.

6. The device of claim 1 wherein said means for moving the arms of the user forwardly and rearwardly comprises:

a. means for rotating a crank shaft attached to said frame;

b. right and left arms pivotally attached to said crank shaft;

c. right and left arm levers attached to said fight and left arms such that rotation of said crank shaft causes said right and left arm levers to move forwardly and rearwardly.

7. The device of claim 6 wherein said crank shaft and said arms are operatively connected such that when said right arm lever is at its most forward position, said left arm lever is at its most rearward position.

8. The device of claim 7 further comprising means for supporting the legs of the user and maintaining the legs of the user in an upright position.

9. A device for exercising the feet, arms, legs, hips and torso of a user comprising:

a. a frame;

b. a rotating crank shaft attached to said frame;

c. right and left foot plates, each of said foot plates having an upper side and a lower side, said underside of each of said foot plates slidably and pivotally attached to a cam arm, each of said cam arms attached to said crank shaft whereby rotation of said shaft causes movement of the feet and legs of the user in a generally circular pattern along a vertical plane;

d. means attached to said foot plates for moving said plates in a generally up and down motion in response to said generally circular movement of the feet and the legs of the user, said up and down motion of said plates causing flexing of the feet and ankles of the user comprising limited slide joints pivotally attached to said frame, each of said limited slide joints having an adjustment rod attached to a guide shaft by two brackets which are releasibly and adjustibly attached along adjustment rod, each of said limited slide joint having a spring receiving said guide shaft, each of said limited slide joint attached to one of said foot plates;

e. left and right arm levers operatively connected to said crank shaft whereby rotation of said crank shaft causes opposing forward and rearward movements of the arms of the user when grasping said levers; and f. means joining said means for moving said plates and said frame for limiting the flexing of the ankles of the user.

* * * * *